United States Patent [19]

Lerch

[11] Patent Number: 4,763,679

[45] Date of Patent: Aug. 16, 1988

[54] TOY UMBRELLA

[75] Inventor: Karl D. Lerch, East Aurora, N.Y.

[73] Assignee: The Quaker Oats Company, Chicago, Ill.

[21] Appl. No.: 71,015

[22] Filed: Jul. 8, 1987

[51] Int. Cl.[4] ..... A45B 25/14

[52] U.S. Cl. ..... 135/20 M; 135/20 R

[58] Field of Search ..... 135/20 R, 20 M, 33 C

[56] References Cited

U.S. PATENT DOCUMENTS

| | | | |
|---|---|---|---|
| 1,833,004 | 11/1931 | Spiro | 135/20 R |
| 3,534,752 | 10/1970 | Vanzini | 135/20 R |
| 3,709,238 | 1/1973 | Leopoldi et al. | 135/20 R |
| 4,632,137 | 12/1986 | Exley et al. | 135/20 R |
| 4,685,482 | 8/1987 | Yung | 135/20 M |

FOREIGN PATENT DOCUMENTS

| | | | |
|---|---|---|---|
| 643719 | 6/1984 | Switzerland | 135/20 M |

*Primary Examiner*—J. Karl Bell

*Attorney, Agent, or Firm*—Cumpston & Shaw

[57] ABSTRACT

A toy umbrella is disclosed comprising an elongated hollow handle member within which a hollow stem is mounted for rotation. A rod is slidably mounted within the handle member and stem, and gear means are provided coupling the handle member to the rod. Upon rotation of the stem, the rod is reciprocally moved between from an outer position in which the umbrella is closed to an inner position in which the umbrella is opened.

8 Claims, 4 Drawing Sheets

TOY UMBRELLA

FIELD IN THE INVENTION

The present invention relates generally to umbrellas, and more specifically to a toy umbrella having a rotatable knob which when rotated in one or the other direction moves the umbrella between its closed and open positions.

BACKGROUND OF THE INVENTION

Large table umbrellas are known in the art in which the umbrella is moved between open and closed positions by means of a crank. Such cranking umbrellas are of rather complicated construction and design and the mechanisms incorporated therein are ill suited for use in hand held umbrellas. Accordingly, a strong need exists in the toy art for a toy umbrella of simple design and construction that can be held by one hand and a handle rotated by the other hand for opening or closing the umbrella.

SUMMARY OF THE INVENTION

An object of this invention is to provide a toy umbrella movable between open and closed positions comprising:

an elongated hollow handle member;

a hollow stem member mounted for rotation within the handle member;

a rod slidably mounted within the handle member and stem;

gear means coupling the handle member to the rod for reciprocally moving the rod from an inner position to an outer position upon rotation of the stem;

an umbrella cover of fabric material having a center portion secured to the outer end of the rod;

rigid stave members secured to the cover in a radially extending pattern from the center portion thereof; and flexible support means coupling the handle member to the stave members whereby movement of the rod to its inner position moves the umbrella cover to its open position, and movement of the rod to its outer position moves the umbrella cover to its closed position.

In a more specific aspect of the invention, the handle member comprises a tube having a hand grip member at one end thereof. The stem is rotatably mounted within the handle member, and has an elongated slot extending through the wall thereof. The gear means comprises a spiral gear tooth on the inner periphery of the hand grip member defining a spiral groove. A laterally extending pin on the rod extending through the slot into the spiral groove.

BRIEF DESCRIPTION OF THE DRAWINGS

In the detailed description of the invention presented below, reference is made to the accompanying drawings, in which.

DETAILED DESCRIPTION OF THE INVENTION

Figure 1:
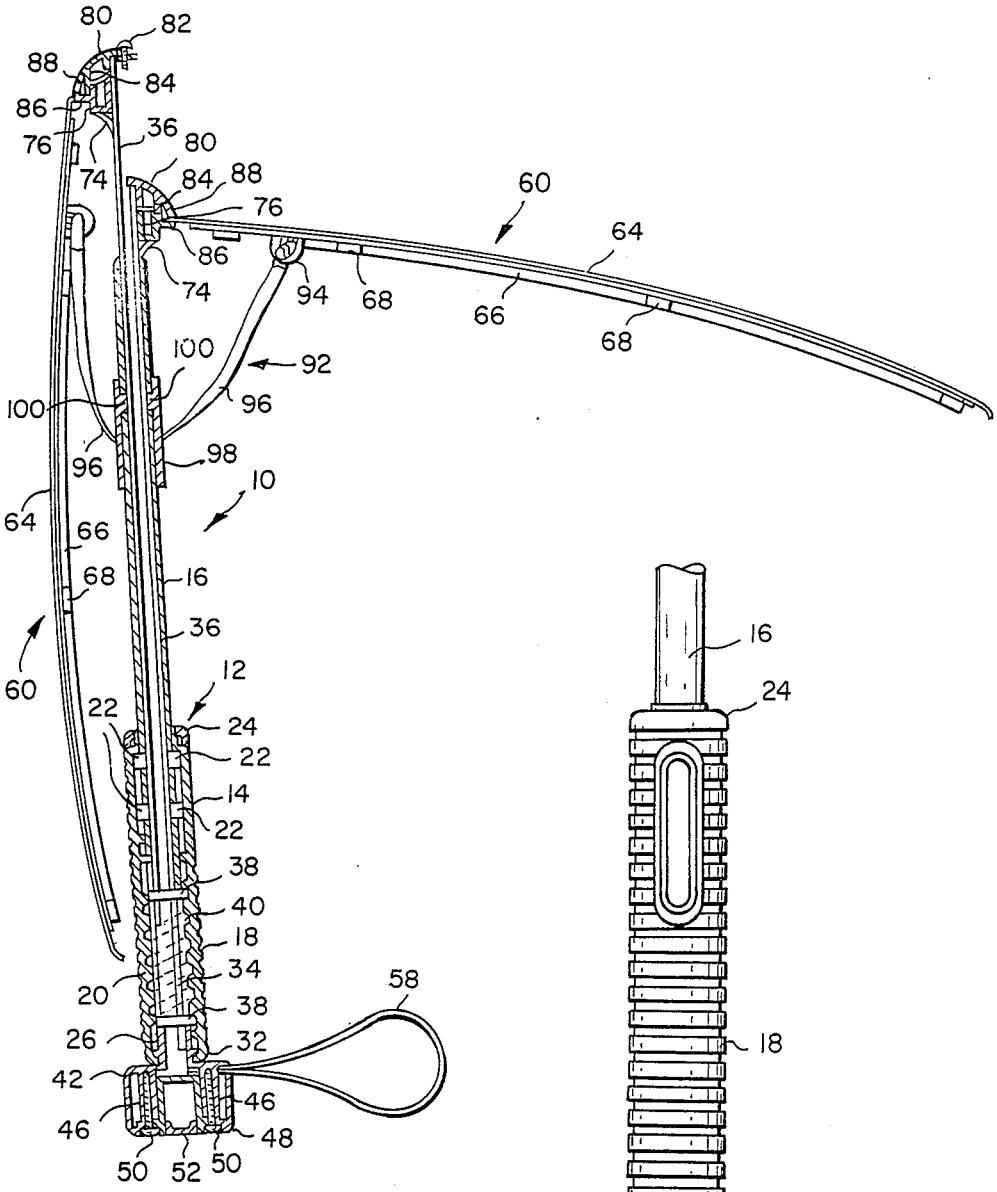
FIG. 1 is a side-elevational view in section showing on the left side the position of the gear means and rod when the umbrella cover is in its closed position, and showing on the right side the position of the gear means and rod when the umbrella cover is in its open position.
Figure 2:
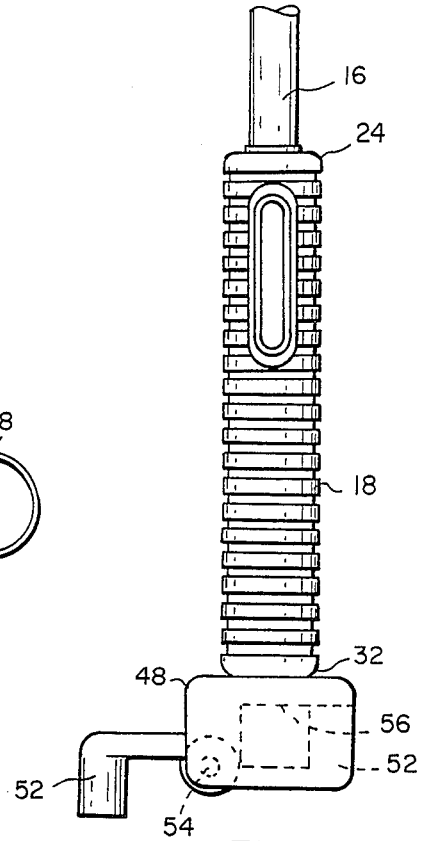
FIG. 2 is a segmental enlarged view of the hand grip member showing the knob handle in a cranking position.
Figure 3:
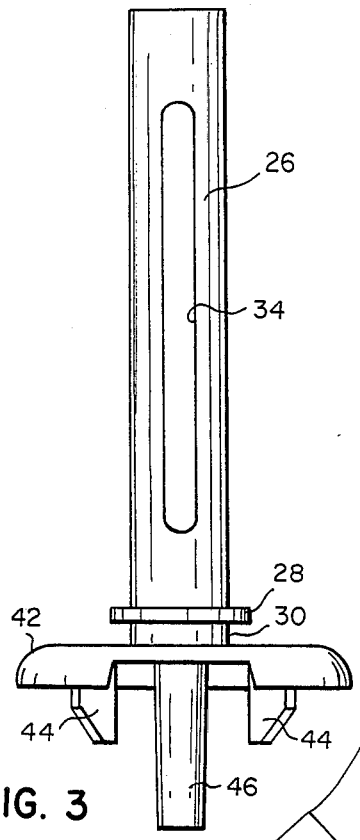
FIG. 3 is an enlarged side-elevational view of the hollow stem member.

With reference to FIGS. 1–3, a preferred embodiment of the toy umbrella 10 of this invention comprises a handle member 12 having a hand grip 14 at one end and a tube 16 at the other. The hand grip 14 comprises a pair of mating semi-cylindrical parts 18, 20 having radially extending posts 22 extending into complementary openings in tube 16 for releasably securing the tube to the hand grip parts 18, 20. The hand grip parts are rigidly secured to tube 16 by a ring 24 encircling the upper ends of the hand grip parts.

A hollow stem member 26, as best seen in FIG. 3, is mounted for rotation within the opposite end of hand grip parts 18, 20. The stem 26 has a ring 28 defining a groove 30 for receiving an inner peripheral rim 32 at the end of the hand grip parts. The stem 26 has elongated diametral slots 34 extending through the wall thereof. A rod 36 is slidably mounted within hollow tube 16 and stem 26, and is provided with a gear pin 38 laterally extending outwardly adjacent the end thereof through elongated slot 34 and into a spiral groove 40 defined by mating gear teeth on the inner periphery of hand grip parts 18, 20. Accordingly, upon rotation of stem 26, rod 36 will rotate therealong by virtue of the pin 38 and slot 34 connection, and pin 38 is guided within spiral groove 40 for raising or lowering rod 36, depending upon which direction stem 26 is rotated.

The means by which stem 26 is rotated comprises a plate-like base member 42 having depending guide fins 44 and a pair of depending mounting posts 46, as best seen in FIGS. 1 and 3. A cup-shaped knob 48 is guided into a position in engagement with base member 42 by guide fins 44 and is secured to the base member by screws 50 passing through openings in knob 48 into threaded blind bores in posts 46. Rotation of the knob is achieved by a crank 52, as best seen in FIG. 2, pivotally mounted within knob 48 on a pivot 54. The pivot end of crank 52 is received within a deep diametral notch 56 in the knob which further receives the crank when it is pivoted to its closed position, seen dotted in FIG. 2, in which the crank is completely embedded within the knob. An umbrella strap 58 has end portions having openings for receiving one of the posts 46 on base member 42. The strap end portions extend through a notch in base member 42 and are held tightly therein by knob 48 when it is secured to base member 42.

Figure 4:
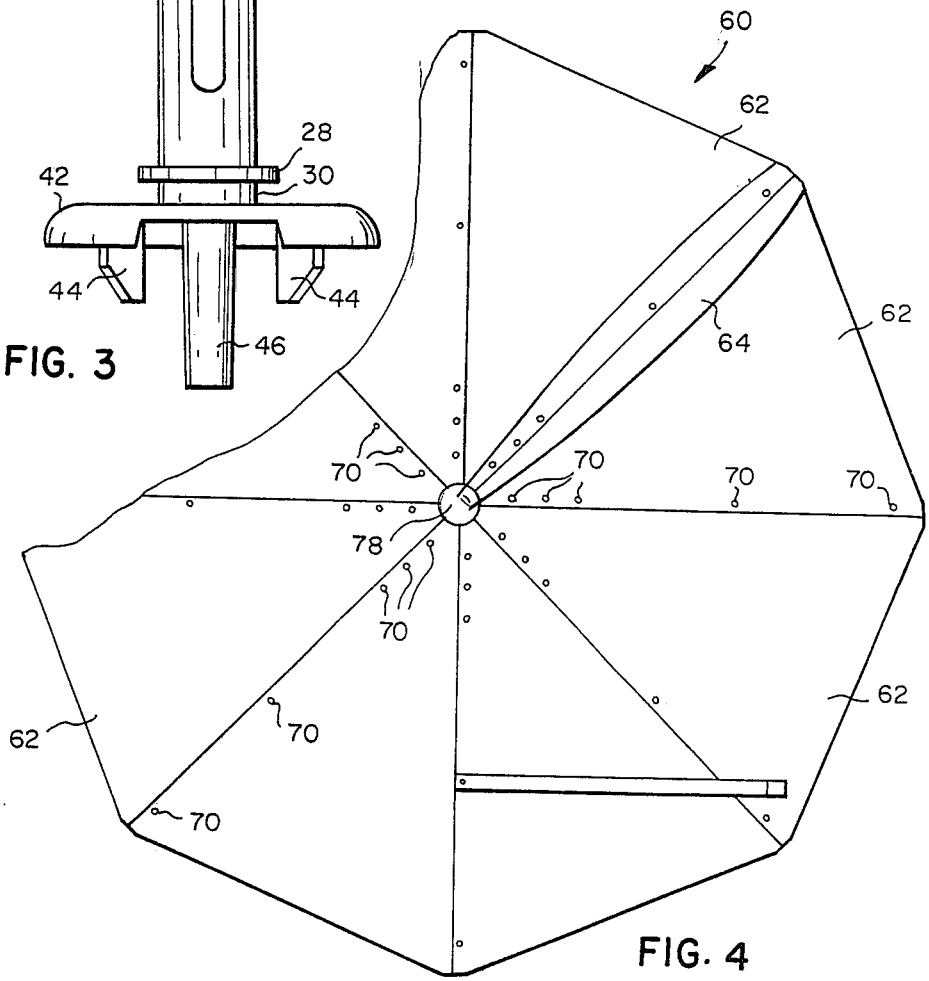
FIG. 4 is a top plan view of the umbrella cover with only one stave member attached thereto.
Figure 5:
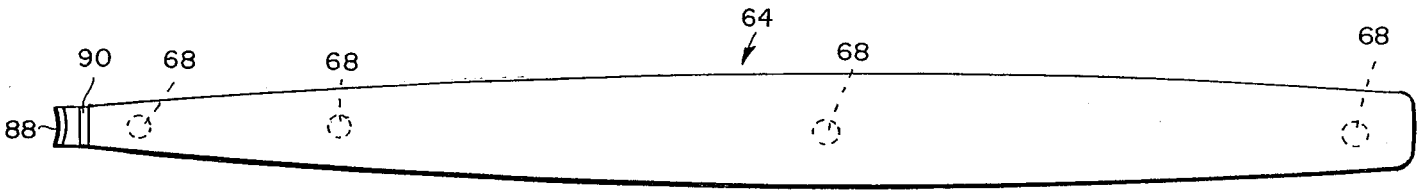
FIG. 5 is a top plan view of an upper stave member of the umbrella cover.
Figure 6:
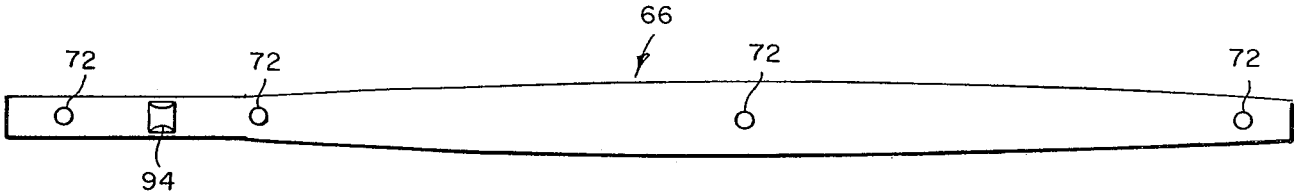
FIG. 6 is a bottom view of the lower stave member of the umbrella cover.

With reference to FIGS. 4–7, the umbrella cover means 60 and how it is secured to handle member 10 will now be described. The umbrella cover means 60 comprises an umbrella cover, as best seen in FIG. 4, formed from a plurality of pie-shaped pieces of flexible fabric material 62 secured together preferably by sewing. The umbrella cover means is rigidified by radially extending upper and lower staves 64, 66 respectively, as best seen in FIGS. 5 and 6, preferably formed of plastic material. The upper stave 64 has depending posts 68 which are pressed through complementary openings 70 in the umbrella cover and into openings 72 in lower stave 66 as the upper and lower stave members 64, 66 are pressed together. Heat is applied to the outer ends of the plastic posts 68 to form heads for securing the upper and lower stave members 64, 66 together.

Figure 7:
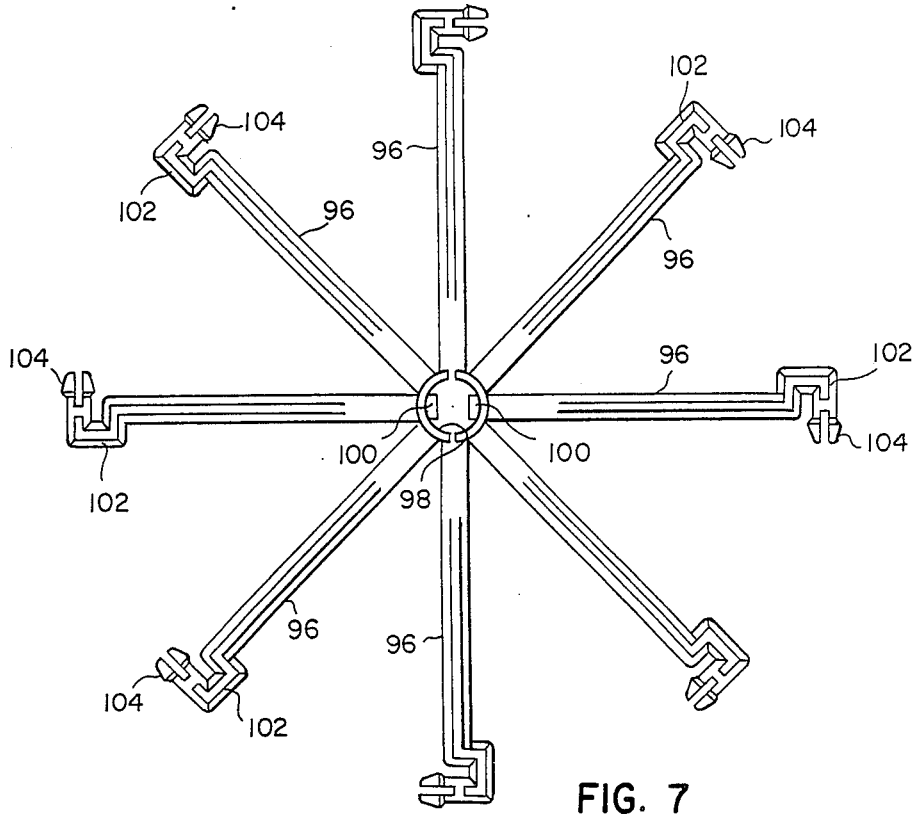
FIG. 7 is a top plan view of the flexible support means for the umbrella cover in an outstretched condition.

With reference to FIGS. 1 and 7, the manner in which the umbrella cover means 60 is secured to the reciprocally movable rod 36 will now be described. A circular clip 74 is mounted on the rod to form a rigid secure base for the umbrella cover means. A lower cap member 76 is mounted on clip 74 and the umbrella cover means mounted on lower cap member 76 with the lower cap member extending into central opening 78 in the cover means (FIG. 4). An upper semi-spherical cap member 80 is mounted on lower cap member 76 and secured to the top of rod 36 by a screw 82. The upper cap member 80 has a depending skirt 84 that cooperates with an annular apron 86 on the lower cap to define an enclosure for receiving the L-shaped ends 88 of upper staves 64. Each L-shaped end 88 is secured to the remainder of the upper stave by a necked-down living hinge 90, as best seen in FIG. 5.

The umbrella cover means is supported intermediate its center and outer periphery by a support means 92 comprising U-shaped eyelets 94 secured to each lower stave member 66. The support means further comprises a plurality of arms 96 extending radially from a unitary sleeve 98 (FIG. 1) secured to tube 16 by press fitting the sleeve on the tube until radially extending posts 100 on the inner sleeve are forced into complementary openings in the tube. The arms 96, as best seen in FIG. 7, each have a U-shaped free end 102 having an enlarged head 104 that is compressible to allow the head to pass throught eyelet 94. The head 104 then expands for releasably securing arm 96 to the lower stave member 66.

Accordingly, when the umbrella is in its closed position as seen in the left side on FIG. 1, gear pin 38 is in the upper position and rod 36 is fully extended. To move the umbrella to its open position, as seen on the right side of FIG. 1, crank 52 is extended, as seen in FIG. 2, and cranked causing gear pin to move down spiral groove 40 to its lowermost position in FIG. 1 causing rod 36 to move therealong to its retracted position. In this position, the radially extending arms 96 support the umbrella in its open position.

While a preferred embodiment of the invention has been shown and described with particularity, it will be appreciated that various changes and modifications may suggest themselves to one having ordinary skill in the art upon being apprised of the present invention. It is intended to encompass all such changes and modifications as fall within the scope and spirit of the appended claims.

What is claimed is:

1. A toy umbrella movable between open and closed positions comprising:

an elongated hollow handle member;

a hollow stem mounted for rotation within the handle member;

a rod slidably mounted within the handle member and stem;

gear means coupling the handle member to the rod for reciprocally moving the rod between inner and outer positions upon rotation of the stem;

an umbrella cover of fabric material having a center portion secured to the outer end of the rod;

rigid stave members secured to the cover in a radially extending pattern from the center portion thereof; and flexible support means coupling the handle member to the stave members whereby movement of the rod to its inner position moves the umbrella cover to its open position, and movement of the rod to its outer position moves the umbrella cover to its closed position.

2. An umbrella according to claim 1 wherein the handle member comprises a tube having a hand grip member at one end thereof.

3. An umbrella according to claim 2 wherein the stem is rotatably mounted within the hand grip member.

4. An umbrella according to claim 3 wherein the stem has an elongated slot extending through the wall thereof, and the gear means comprise a spiral gear tooth on the inner periphery of the hand grip member defining a spiral groove and a laterally extending pin on the rod extending through the slot into the groove.

5. An umbrella according to claim 4 wherein the stem has a knob at one end thereof for imparting rotation to the stem.

6. An umbrella according to claim 5 wherein a crank is pivotally mounted on the knob for pivotal movement between an extended position for cranking the knob and stem, and a retracted position in which the crank is embedded in the knob.

7. An umbrella according to claim 1 wherein the support means comprises a plurality of flexible arms having one end of each arm secured to the handle member, and means on the opposite end of each arm for pivotally securing each opposite end to a complementary stave member.

8. An umbrellas according to claim 7 wherein each stave member has a depending eyelet on the undersurface thereof, and wherein the means on the opposite end of each arm comprises a U-shaped end portion transverse to the arm and having one end thereof secured to the arm, and a free end thereof having a contractable head insertable through the eyelet where it expands for pivotally securing the arm and head to the eyelet.

* * * * *